United States Patent [19]

Garcia

[11] 4,336,706

[45] Jun. 29, 1982

[54] LATHEKIN

[76] Inventor: Alberto A. Garcia, 6940 56th Ave. South, Seattle, Wash. 98118

[21] Appl. No.: 150,001

[22] Filed: May 15, 1980

[51] Int. Cl.[3] ..... B21D 3/16

[52] U.S. Cl. ..... 72/479; 7/166; 81/3 R

[58] Field of Search ..... 72/479, 476, 457; 7/166, 169, 170, 105; 81/3 R; 29/402.19, 235

[56] References Cited

U.S. PATENT DOCUMENTS

| | | | |
|---|---|---|---|
| 1,519,228 | 12/1924 | Webber | 81/3 R |
| 1,783,077 | 11/1930 | Ferguson | 72/479 |
| 1,783,078 | 11/1930 | Ferguson | 72/479 |
| 1,883,684 | 10/1932 | Garrett . | |
| 2,485,488 | 10/1949 | Ferguson . | |
| 2,525,226 | 10/1950 | Lawellin | 7/166 |
| 2,670,535 | 3/1954 | Ogden . | |
| 2,912,888 | 11/1959 | Webb | 72/457 |
| 3,041,900 | 7/1962 | Wagner | 72/457 |
| 3,134,574 | 5/1964 | Reuterfors | 7/166 |
| 3,531,975 | 10/1970 | Lance | 72/457 |

*Primary Examiner*—Gene Crosby
*Attorney, Agent, or Firm*—David H. Deits; Roy E. Mattern, Jr.; Gregory W. Moravan

[57] ABSTRACT

A lathekin for use in stain glass window construction and the like has a handle with a blade attached to one end. The blade has a main convex edge which is doubly beveled. Spaced along the edge are two pairs of transverse projections. The transverse projections each have a tapered leading edge and a tapered trailing edge on either side of a peak. The peak extends from the edge of the blade inwardly to at least the depth of the channel of the came used in stained glass panel construction. The blade has a trailing edge which is also doubly beveled and which extends from a substantially normal intersection with the main blade edge to form a concave curve with the handle. On the opposite side of the handle is a concave upper edge which intersects with the main blade edge to form a point. A second blade is transversely mounted on the opposite end of the handle. It has a thin edge which extends transversely to the handle terminating in a substantially rectangular corner at one side and a smoothly radius corner at the opposite side. The handle and the blade are concavely curved along the edge joining the trailing edge of the first blade and of a length such that a portion of the handle and the second blade rests in the palm of the user's hand and the user's index finger tip rests on the upper edge of the blade when the hand is placed along the handle.

11 Claims, 8 Drawing Figures

FIG. 1
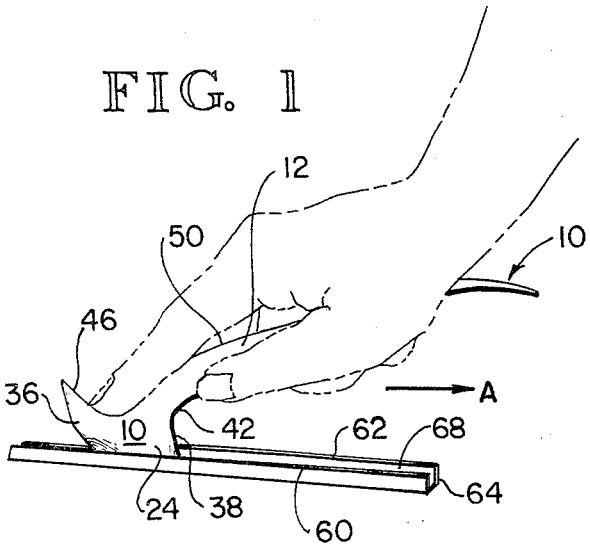
FIG. 2
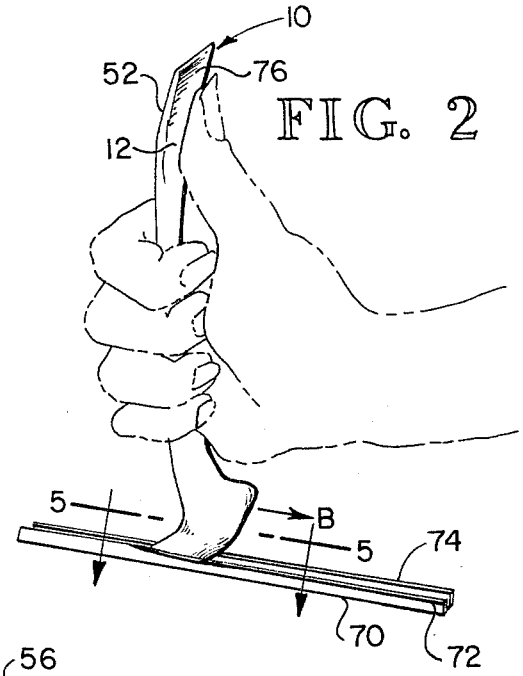
FIG. 3
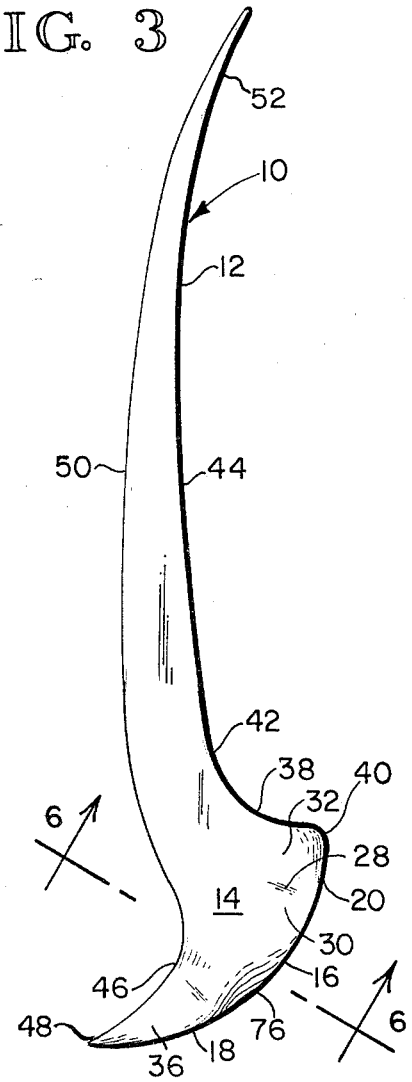
FIG. 4
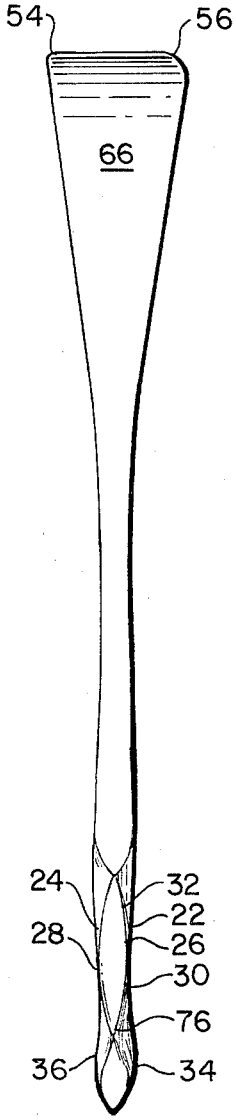
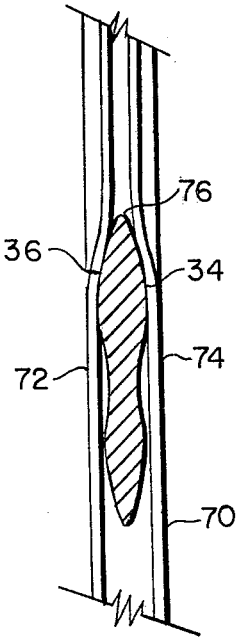
FIG. 5

LATHEKIN

BACKGROUND OF THE INVENTION

1. Field of the Invention

The invention relates to lathekin and tools of the type used in connection with the construction of stained glass windows and working with lead and other types of came used in the construction of stained glass windows.

2. Description of the Prior Art

One type of lathekin used previously consists of a plastic strip having a rectangular cross-section which has tapered ends which is used in the opening of the leaves of the came and then flattening the lead leaves after the glass is fitted within the came. Another form of lathekin consists of a wood strip that has an edge of convex curvature which is beveled on either side. Lathekins similar to the wooden one just previously described are often provided with a handle. A fid, which is a tapered wooden pin for separating the strands of rope in splicing, is often used as a lathekin. Another type of previously used lathekin consists of a hardwood dowel having a conical tip. The opposite end of the dowel may be provided with linear end edge formed by beveling the opposite sides of the dowel.

SUMMARY OF THE INVENTION

A lathekin of the type used in connection with construction of stained glass windows and the like is provided. The tool performs the conventional function of lathekins; namely, opening the leaves of came. It is also usable for the purposes of inserting putty in between the glass and the came; cleaning putty from the corners formed by the surface of the glass and the came; lifting the glass panels from the work surface; dressing copper foil and the like used in stained glass construction; flattening the leaves of the came after the insertion of glass; and cleaning excess putty from the surfaces of the glass. The lathekin in its preferred form has a handle with a blade attached to one end. The main edge of the blade which is opposite the handle has a convex curvature to it and is beveled on either side to form a thin edge. Spaced apart from each other along the edge of the blade are two pair of transverse projections. Each of the projections have a tapered leading edge and a tapered trailing edge on either side of a central peak. The peak consists of a ridge which extends from the edge of the blade inwardly to at least the depth of the channel of the came with which the tool is to be used. The peaks of the projections extend outward from the blade to engage the leaves of the came to space them relative to each other. The peaks of the second pair of projections are spaced from the blade differently from the first pair to engage leaves of came having a different channel width. The blade is provided with a trailing edge which is also doubly beveled and forms a substantially normal intersection with the main blade edge. The trailing edge forms a concave curve from its intersection with the main blade edge to the handle. The blade has an upper edge which connects with the handle opposite the trailing edge and sweeps in a concave curve to a point of intersection with the main blade edge forming a point for cleaning corners. A second blade is transversely mounted with respect to the first blade on the opposite end of the handle. The blade has a thin edge which extends transversely to the length of the handle and terminates at one corner in a substantially rectangular corner and on the opposite side in a smoothly curved corner. The handle and the blade are concavely curved along the trailing edge of the first blade and are of such a length that a portion of the handle and the second blade rests in the palm of the user's hand and the tip of the user's index finger rests on the upper edge of the blade when the hand is placed along the handle with the remaining fingers gripping the handle.

DETAILED DESCRIPTION OF THE INVENTION

The invention relates to lathekins of the type used in connection with the construction of stained glass windows and similar items. The tool performs the conventional function of lathekins; namely, opening the leaves of the came. Came is the channel, usually of lead or zinc, having a U or H-shaped cross-section which receives the marginal edge of the glass panels. The invention is also usuable for the purposes of inserting putty in between the glass and the came; cleaning putty from the corners formed by the surface of the glass and the came; lifting the glass panels from a work surface; dressing copper foil and the like used in stained glass construction; flattening of the leaves of the came after the insertion of the glass; and cleaning excess putty from the surface of the glass.

BRIEF DESCRIPTION OF THE DRAWINGS

FIG. 1 is a perspective view of the preferred embodiment of the lathekin being used to open the leaves of a piece of came.

FIG. 2 is a perspective view illustrating the use of the preferred embodiment of the lathekin and illustrating how the handle is tilted to use the tool in opening the leaves of came having a different width from that illustrated in FIG. 1 by engaging a second set of projections on the blade.

FIG. 3 is a side elevation view of the preferred embodiment of the invention.

FIG. 4 is a bottom plan view of the tool as would be seen when viewing the tool from the right hand side in FIG. 3.

FIG. 5 is a top section view from FIG. 4 through the tool when being used to open the leaves of came, showing how the projections 34 and 36 are utilized to space the leaves.

The invention is shown in its preferred form in FIGS. 1 through 6. Referring to FIG. 3, the lathekin 10 is preferably constructed of a plastic material; such as, Delrin No. 500 N.C. 10 available from E. I. du Pont de Nemours and Company, 80 Universal City Plaza, Suite 400, P.O. Box 8950, Universal City, CA 91608; where the lathekin is to be used with lead came or for working with copper foil as discussed below. Where the tool is to be used with zinc came, it is preferred that the lathekin be constructed of brass. The lathekin is provided with an elongated central handle 12. A blade 14 is attached to one end of the handle. The blade has an elongated main edge 16 which is doubly tapered to form a relatively sharp edge. It has a front and rear portion, 18 and 20 respectively, which are angularly disposed with respect to one another. Preferably, the main edge is convexly curved with the front and rear portions disposed along the edge. The blade is provided with a pair of projections 22 and 24 which project oppositely from the sides of the blade along the rear portion, as shown in FIG. 6. Each projection is provided with a ridge, 26 and 28 respectively, which extends, preferably at an angle normal to the blade edge at its closest point, from at or near the edge to at least the depth of the channel with which the lathekin is to be used. Referring to projection 22 as a representative form of the preferred form of the projection, the projections have a sloping leading trailing surface 30 and a sloping leading surface 32 which smoothly connect the peak of the projection to the lateral surfaces of the blade and extend along the blade adjacent to the edge. In its preferred form, a second pair of projections 36 and 34 which also have sloping leading and trailing surfaces are placed along the front portion of the blade. The peak of these projections, by virtue of their positioning along the main edge, extend at an angle with respect to the peak of the first pair of projections, 22 and 24. The peaks of projections 34 and 36 are, for the reasons discussed below, spaced differently from the peaks of projections 22 and 24. The blade 14 is provided with a trailing edge 38 which is doubly tapered and intersects the main edge 16 at a substantially normal intersection 40. The point of intersection is preferably rounded slightly. The trailing edge is joined in a smooth concave curve 42 to one surface 14 of the handle 12. The blade 14 is provided with an upper edge 46 which is concave and intersects with the main edge 16 to form a point 48. The upper edge connects in a smooth curve to the smoothly curved convex surface 50 of the handle.

In its preferred form, the end of the handle opposite the blade 14 is provided with a second blade 52 which is relatively thin and transversely mounted with respect to blade 14. As shown in FIG. 3, the blade has a tapered cross-section and continues the smooth curvature of the handle 12. As shown in FIG. 4, the blade preferably is generally triangular shape and has opposite corners, 54 and 56 respectively, which are differently shaped. Corner 54 is preferably a substantially right angled corner and the corner of 56 preferably hs a smooth convex curvature to it.

The use of the lathekin in its conventional use of opening the leaves of came, is illustrated in FIGS. 1, 2, 5 and 6. FIG. 1 illustrates the position in which the lathekin be held to utilize projections 22 and 24, to open the leaves 60 and 62 of a piece of came 64. As can be seen from the drawing, the user's index finger rests in the curvature formed between the upper edge 46 of the blade and the surface 50 of the handle. The handle 12 is of such a length that the upper portion of the handle and the blade's flat upper surface 66 rest in the palm of the user's hand. In opening the leaves of the came, the tool is preferably drawn in the direction of the arrow A. Because of the curvature of the blade and the angular placement of the two pairs of projections with respect to one another, only one pair of projections fit within the channel 68 of the came at a time. And the ridges of the projection are spaced to contact the interior surfaces of the leaves of the came in order to space the leaves relative to one another. The triangular shape of the blade 52 aids in gripping the tool. The doubly tapered leading edge of the blade 14 and smooth leading edges of the projections 22 and 24 allow for the smooth opening of the channel whose leaves may be bent so as to contact each other. The peaked form of the projection surface minimizes the frictional contact since the blade is thinner than the spacing of the leaves of the channel with which the tool is intended to be used.

FIG. 2 illustrates the rotated relationship of the tool with respect to a second section of channel 70 whose leaves 72 and 74 are more closely spaced with respect to each other than that of channel 64. In this mode of use, the handle is held in more upright position with the fingers wrapped about the handle 12 and the thumb placed on the under surface 76 of the blade 52. As shown in the section view in FIG. 5 projections 34 and 36 are utilized to space the leaves. The narrow portion of the main edge between the projection pairs is wedged between the leaves of the came as the tool is drawn in the direction of the arrow B in the same way that the trailing edge served the same function when the tool is used as shown in FIG. 1.

FIG. 6, a section along the line 6—6 from FIG. 3, illustrates the tool in use with a section of H-shaped came. The ridge 26 of the projection, in its preferred form, extends at least to the height of the channel. In its preferred form, the ridge is parallel to the lateral surfaces of the blade, but need not necessarily be so. The ridge may taper inwardly from a maximum point at 80, so that only the upper portion of the channel walls are properly spaced. With such a structure, the edge of the glass panel can be utilized to force the remainder of the channel walls outwardly to the necessary separation upon insertion.

Figure 6:
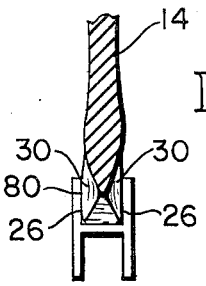
FIG. 6 is a section view along the lines 6—6 in FIG. 3 illustrating the tool as used to open a section of H-shaped came showing the ridge 26 and the sloping leading surface 30.

As can be seen from FIG. 2, the length of the handle is, in its preferred form, dimensioned such that only a short portion of the tool extends below the hand and blade 52 extends above the hand so that the thumb may comfortably rest on the underside of the blade 76 to permit firm guidance and control of the tool.

As shown in FIG. 1, the concave curvature at 42 and the shape of the trailing edge reduce friction of the tool during use and allow viewing of the work.

The blade 52 may be used in a fashion similar to a putty knife to insert putty between the came and the glass which is done to seal the assembled panel. The corners 54 and 56 are used to clean the excess putty from the corners formed by the came and the glass. The more rounded corner 56 is used on an initial pass and the right angle corner 54 is used on later passes to more thoroughly clean the intersection.

The blade and curved handle permit the blade 52 to be inserted underneath a glass panel which is laying flat on a work bench in order to permit the glass panel to be grasped. The rounded corner 56 aides in sliding the blade under the glass panel.

The blade 52 may be used with the fingers on the hand wrapped around the handle 12 and the index finger resting on the rear surface 76 of the blade when dressing copper foil, also used in stained glass construction, or flattening the leaves of the came after the glass is inserted.

The thin nature of the tip of the blade 52 and the flexible nature of the plastic material from which it is constructed give the artist a "feel" of the glass when the tool is used for applying putty.

The sharp point 48 formed by the upper edge and its intersection with the main edge 16 is used to clean excess putty from the corners of the came and glass.

The blade 52 is utilized for cleaning putty from the surface of the glass.

Figure 7:
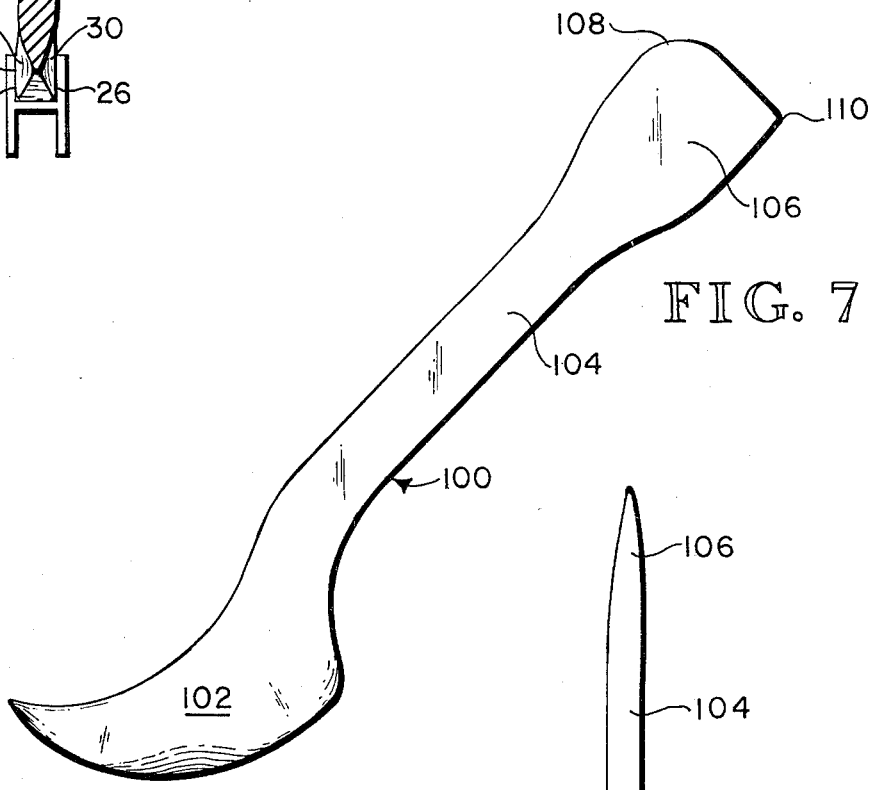
FIG. 7 is a side elevation view of an alternative embodiment of the invention.
Figure 8:
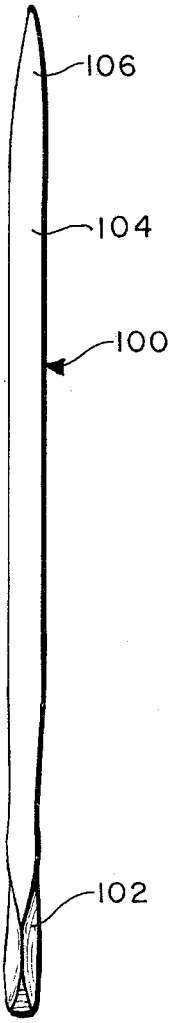
FIG. 8 is a bottom elevation view of the alternate embodiment from FIG. 7 as would be seen when looking from the lower right in FIG. 7.

FIGS. 7 and 8 illustrate an alternate version of the lathekin 100. The blade 102 is substantially identical to that in the preferred embodiment described above except that the overall shape has been changed somewhat. This illustrates that the blade 102 can change somewhat in shape without the functionality of this portion of the tool being sacrificied. The handle 104 differs from the handle 12 of the preferred embodiment in that it terminates at its end opposite the blade 102 in a blade 106 which lies substantially in the same plane as the blade 102. The rounded corner 108 and the right angle corner 110 perform the same functions as the corresponding portions 56 and 54, respectively, of the preferred embodiment 10.

I claim:

1. A lathekin for opening the leaves which form the channel of came, which comprises:

(a) a blade having an elongated main edge insertable within the channel;

(b) a pair of peaked projections extending oppositely from the sides of the blade in a plane substantially normal to the plane of the blade, each having a sloping leading surface and a sloping trailing surface on either side of the peak extending along the blade adjacent to a portion of the edge, said sloping leading surfaces of the projections defining a point located substantially in the plane of the blade the peaks of the projections extending outward from the sides of the blade to engage the leaves of the came and space them relative to each other.

2. A lathekin for opening the leaves which form the channel of came, as claimed in claim 1, wherein the projections extend from the edge of the blade inwardly with the peaks of the projections forming ridges which extend from the main edge to at least the depth of the channel.

3. A lathekin for opening the leaves which form the channel of came, as claimed in claim 1, wherein the blade edge is doubly tapered on either side of the projection to permit easy insertion of the blade in the channel.

4. A lathekin for opening the leaves which form the channel of came, as claimed in claim 1, wherein the blade has a first main edge portion angularly disposed relative to a second main edge portion and has a second pair of projections on the second main edge portion with the first pair of projections positioned along the first main edge portion, the second pair of projections extending oppositely from the sides of the blade, each projection having a sloping leading surface and sloping trailing surface on either side of a peak extending along the blade adjacent to the second main edge portion, the distance between the peaks of the second pair of projections being different than the distance between the peaks of the first pair of projections to engage the leaves of came having a different channel width.

5. A lathekin for opening the leaves which form the channel of came, as claimed in claim 4, wherein the blade has a convex main edge with the first and second edge portions spaced from each other along the convex edge.

6. A lathekin for opening the leaves which form the channel of came, as claimed in claim 1, which further comprises a handle which is attached to the blade opposite its main edge, and wherein the blade has a concave upper edge extending from the handle to an intersection with the blade main edge to form a point for cleaning putty and the like from corners.

7. A lathekin for opening the leaves which form the channel of came, as claimed in claims 6, wherein the blade has a trailing edge which is doubly tapered and extends from a substantially normal intersection with the blade main edge in a concave curve to the handle.

8. A lathekin for opening the leaves which form the channel of came, as claimed in claim 7, wherein the handle has a first end to which the blade is attached and a second end opposite its first end and further comprising a second blade attached to the handle at the second end and having a relatively thin, transverse edge for scraping or inserting putty.

9. A lathekin for opening the leaves which form the channel of came, as claimed in claim 8, wherein the second blade has one corner which is a smooth convex curve and an opposite corner which is substantially a right angle corner.

10. A lathekin for opening the leaves which form the channel of came, as claimed in claim 8, wherein the second blade is transversely attached to the handle with respect to the first blade.

11. A lathekin for opening the leaves which form the channel of came, as claimed in claim 10, wherein the handle is curved in a manner such that, during use of the lathekin, a portion of the handle and the second blade will rest in the palm of the user's hand and the user's index finger tip will rest on said concave upper edge of the first blade when the hand is placed along the handle.

* * * * *